United States Patent [19]

Korby et al.

[11] 4,046,252

[45] Sept. 6, 1977

[54] CIGARETTE PACK

[76] Inventors: Leonard A. Korby, 12411 S. 76th Ave., Palos Heights, Ill. 60463; Norris K. Heard, P.O. Box 432, Channahon, Ill. 60410

[21] Appl. No.: 677,789

[22] Filed: Apr. 16, 1976

[51] Int. Cl.[2] ..... A24F 15/10; B65D 85/10

[52] U.S. Cl. ..... 206/95; 206/216; 206/236

[58] Field of Search ..... 206/95, 216, 236, 237

[56] References Cited

U.S. PATENT DOCUMENTS

| | | | |
|---|---|---|---|
| 2,117,342 | 5/1938 | McPherson | 206/95 |
| 3,027,002 | 3/1962 | Letourneur | 206/95 |

*Primary Examiner*—William T. Dixson, Jr.

*Attorney, Agent, or Firm*—Gross, Simpson, Van Santen, Steadman, Chiara and Simpson

[57] ABSTRACT

This invention relates to a cigarette pack of the crush-proof type which conventionally has front and back walls joined by side walls into a substantially rigid package, the pack having a top hinged at the back wall and cooperating with the front wall to form a cover for the pack. The improved cigarette pack of the present invention is provided with means defining a slot near the bottom of the front wall of the container, the slot extending at an acute angle greater than 0° and less than 45° to the transverse dimension of the front wall. The slot is spaced from the upper edge of the front wall a distance sufficient to accommodate the back of a book of matches when the back of such book is received through the slot and extends behind the front wall.

4 Claims, 4 Drawing Figures

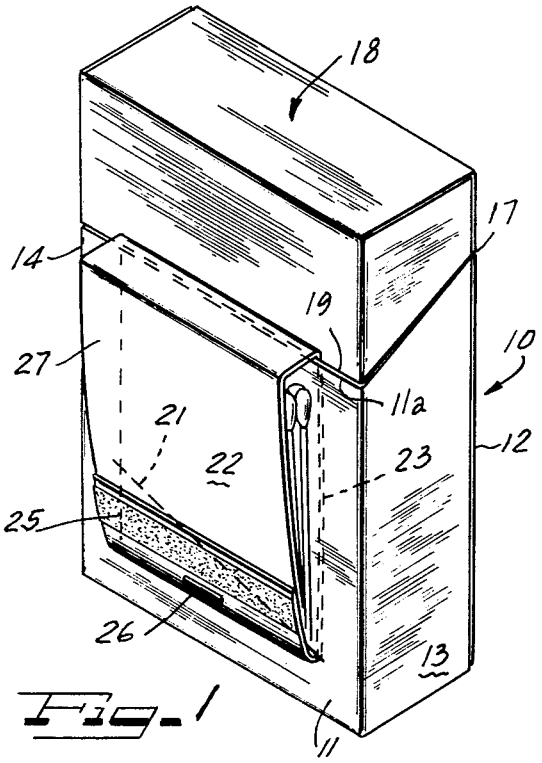
Fig. 1
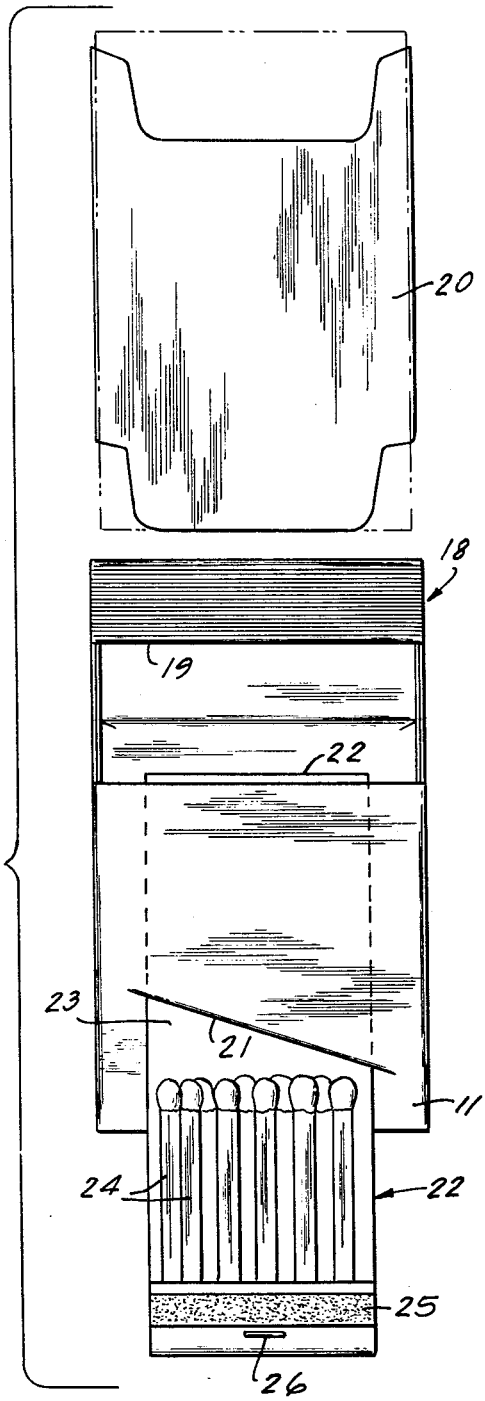
Fig. 3
Fig. 2
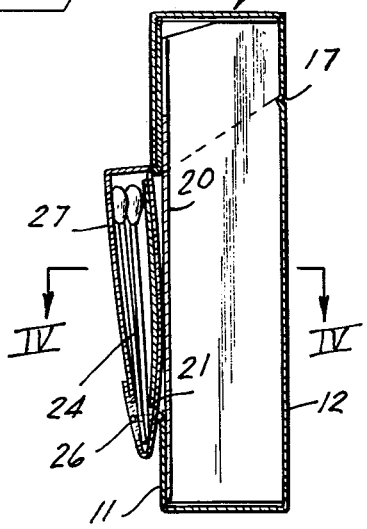
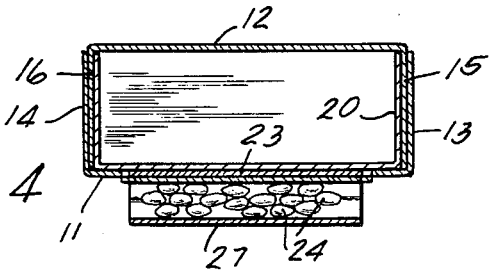
Fig. 4

CIGARETTE PACK

BACKGROUND OF THE INVENTION

1. Field of the Invention

This invention is in the field of cigarette packs being provided with means for attaching a match book thereto in firmly fixed relation.

2. Description of the Prior Art

Smokers who do not carry pocket lighters are always faced with the problem of having enough matches handy to light their cigarettes as the occasion arises. Since cigarette packs and matches are frequently kept on different locations, it is frequently necessary for the smoker to fumble through his apparel in search of a book of matches.

There have been some disclosures in the prior art of combining match book holding means with cigarette packages. Thus, in McPherson U.S. Pat. No. 2,117,342 there is shown a cigarette package which has a plurality of V-shaped slots in the front of the cigarette package for holding a book of matches thereagainst. Similar disclosures relating to combined cigarette pack-match book structures will be found in U.S. Pat. Nos. 1,819,395; 2,148,459; and 2,268,934.

SUMMARY OF THE INVENTION

The present invention provides an improved cigarette pack of the crushproof or hard top or flip top box type. This type of cigarette pack has vertical front and back walls joined by side walls into a substantially rigid package, with a top being hinged at the back wall and cooperating with the front wall to form a cover for the pack. The cover has a bottom edge spaced from the upper edge of the front wall, to leave a slight opening therebetween. In accordance with the present invention, we provide a slot near the bottom of the front wall extending at an acute angle greater than 0° but less than 45° to the transverse dimension of the front wall. The slot is spaced from the upper edge of the front wall a distance sufficient to accommodate the back of a book of matches once the back is received through the slot and extends behind the front wall. The lower edge of the slot engages the book of matches at such a position that the front cover of the match book can be folded over and engaged in a firmly locked position behind the striker, as is customary in match book design. The match book is consequently held quite firmly against the front of the crushproof box so that the user can strike individual matches against the striker without danger of relative movement between the match book and the cigarette pack.

BRIEF DESCRIPTION OF THE DRAWINGS

Other objects, features and advantages of the invention will be readily apparent from the following description of certain preferred embodiments thereof, taken in conjunction with the accompanying drawing, although variations and modifications may be effected without departing from the spirit and scope of the novel concepts of the disclosure, and in which:

FIG. 1 is a view in perspective of a cigarette pack having a match book attached thereto in accordance with the present invention;

FIG. 2 is a cross-sectional view of the structure shown in FIG. 1;

FIG. 3 is an exploded view of the cigarette pack and match book assembly; and FIG. 4 is a cross-sectional view taken substantially along the line IV—IV of FIG. 2.

DESCRIPTION OF THE PREFERRED EMBODIMENTS

In FIG. 1, reference numeral 10 indicates generally a cigarette pack of the crushproof or flip top type, the pack 10 including a front wall 11, a back wall 12 and opposed side walls 13 and 14. Actually, as shown in FIG. 4, it is conventional to make the front walls and side walls of two separate blanks, one blank being constituted by the front wall 11 and side walls 13 and 14, while the rear wall 12 is part of a blank containing side walls 15 and 16 which are adhesively secured or otherwise fastened to the side walls 13 and 14, respectively.

The rear wall 12 is provided with an integral hinge 17 to form a hinged cover 18. A forward edge 19 of the cover is spaced from an upper edge 11*a* of the front wall 11 by a small amount to provide a relatively small opening therebetween.

Most crushproof cigarette boxes also have an inner liner 20 fitting just inside the inner periphery of the cigarette pack enclosure. The liner 20 may extend the full length of the front wall 11 as shown in the drawings, or in some cases may extend one half or so of the length of the front wall.

In accordance with the present invention, we provide a slot 21 near the bottom of the front wall 11, the angle of the slot 21 being greater than 0° but less than 45° from the transverse dimension of the front wall 11. For conventionally sized match books and cigarette packs, the angle provided by the slot 21 with the horizontal (transverse) is about 13½°, when the slot extends upwardly from the lower right as shown in FIG. 3. It is also possible to have the slot 21 extend upwardly from the lower left, in which case the angle of greater than 0° but less than 45° would be measured along a line 180° from the reference line used in FIG. 3.

The angle of disposition of the slot 21 makes it convenient to slip a match book 22 into proper alignment with the front wall 11 of the cigarette pack. The back 23 of the book 22 is inserted in the angularly disposed slot 21 between the rear surface of the front wall 11 and the inner liner 20. The upper end of the match book cover is then pushed through the opening between the lower top edge 19 and the upper edge 11*a* of the cigarette pack. The entire pack is then pulled inwardly until the lower end of the slot 21 is wedged behind the matches 24 contained in the match book 22. In accordance with common practice, the match book 22 is provided with a striker 25 and the entire book is held together by means of a staple 26. The distance between the slot 21 and the opening between the surfaces 19 and 11*a* is such that the entire back 23 of the match book cover extends through such opening, and the front 27 is then folded down in the conventional way so that the marginal edge of the front is received behind the striker 25 in firmly engaged position. When the lower end of the slot 21 engages the cover back 23 behind the matches 24, the staple 26 is wedged against an intermediate portion of the slot 21. This locks the match book cover 22 firmly in place at two points, permitting the user to strike matches against the striker 25 without danger of dislodging the match book from its firmly held position.

The present invention provides a convenient means for transforming a conventional crushproof cigarette pack into a combination cigarette pack and match book holder. The only additional manufacturing step involved is providing a slot in the front wall of the pack which can be done very simply and very inexpensively at the time the blanks are cut prior to being formed into the container.

From the foregoing, it will be appreciated that the improved cigarette package of the present invention provides all of the conveniences of the normal crushproof box and in addition provides a means for fixedly securing a conventional book of matches thereto.

By the simple provision of an angular slot in a particular location in the front of the pack, we provide everything necessary to attach and firmly secure a book of matches to the cigarette pack.

It will be evident that various modifications can be made to the described embodiments without departing from the scope of the present invention.

We claim as our invention:

1. In a cigarette pack of the crushproof type having vertical front and back walls joined by side walls into a substantially rigid package, said pack having a top hinged at the back wall and cooperating with the front wall to form a cover for the pack, said cover having a bottom edge spaced from the upper edge of said front wall, the improvement which comprises means defining a straight line slot near the bottom of said front wall extending at an acute angle greater than 0° to the transverse dimension of said front wall and being spaced from said upper edge of said front wall a distance sufficient to accommodate the back of a book of matches when said back is received through said slot and extends behind said front wall, the slot being proportioned such that its lower end is wedged behind the matches in a book of matches when the back of said book is received through said slot.

2. The pack of claim 1 which includes an inner liner fitting within said pack, the back of said book of matches being received between the outer periphery of said liner and the rear face of said front wall.

3. The pack of claim 1 in which said angle is greater than 0° but less than 45°.

4. A combined cigarette pack-match book assembly comprising a cigarette pack of the crushproof type having a front wall, a rear wall of greater vertical dimension than said front wall, side walls spacing said front and rear walls apart into a substantially rigid structure, a top hingedly extending from said rear wall and having a forward edge spaced from the upper edge of said front wall by a narrow opening, means on said front wall defining a straight line slot at an angle of greater than 0° but less than 45° to the transverse dimension of said front wall, a match book having a back extending through said slot and through said narrow opening to thereby fixedly secure said match book to said cigarette pack, said match book having a staple therein securing its matches to the back of said match book, the angle of said slot and its position being such that the lower end of the slot engages said back, and said staple is wedged against an intermediate portion of said slot.

* * * * *